US005388712A

United States Patent [19]

Brody

[11] Patent Number: 5,388,712

[45] Date of Patent: Feb. 14, 1995

[54] SQUEEZE BOTTLE TOP WITH INTEGRAL CLOSURE HOLDER

[75] Inventor: Harvey Brody, Costa Mesa, Calif.

[73] Assignee: Norvey, Inc., Santa Ana, Calif.

[21] Appl. No.: 93,360

[22] Filed: Jul. 19, 1993

[51] Int. Cl.[6] ..... B65D 37/00; B65D 47/00

[52] U.S. Cl. ..... 215/229; 215/1 A; 220/379; 220/705; 220/709; 222/211; 222/215; 222/379; 222/464; 222/522; 222/530; 222/538

[58] Field of Search ..... 215/1 A, 229, 100 R; 220/379, 705, 707, 709; 222/211, 215, 379, 464, 522, 523, 526, 530, 538; 229/103.1

[56] References Cited

U.S. PATENT DOCUMENTS

| | | | |
|---|---|---|---|
| D. 200,364 | 2/1985 | Brody | D58/26 |
| 4,462,544 | 7/1984 | Rutzel et al. | 239/33 |
| 4,911,315 | 3/1990 | Shrum | 215/229 |
| 4,925,128 | 5/1990 | Brody | 222/211 |
| 5,048,705 | 9/1991 | Lynd et al. | 215/1 A |

*Primary Examiner*—Allan N. Shoap
*Assistant Examiner*—Nova Stucker
*Attorney, Agent, or Firm*—Klein & Szekeres

[57] ABSTRACT

A molded plastic container top has an upper surface from which extends an extensible dispensing tube with a liquid dispensing orifice. The orifice is closed by a removable closure in the form of a cap-like, hollow, open-ended body. A plug is formed integrally with the upper surface and extends upwardly therefrom. Extending upwardly from the plug is an integral, cylindrical, rod-like stopper extension. In the preferred embodiment, the plug is axially fluted, with three radial vanes, dimensioned to be received into the interior of the closure to retain the closure thereon with a frictional fit. The stopper extension is dimensioned to be received within dispensing orifice with a fluid-tight fit, so as to provide an alternative closure for the orifice when the dispensing tube is extended to bring the orifice into the proximity of the stopper extension. The maximum thickness of the vanes is less than or equal to the thickness of the top at the upper surface, so that the formation of the plug does not leave a significant "sink mark" on the underside of the top, opposite the plug. The ratio of the maximum thickness of the vanes to the thickness of the top at the upper surface is advantageously in the range of about 1:3 to about 3:4, with a specific preferred embodiment having a ratio of about 2:3. Other ratios, less than or equal to 1:1, should provide satisfactory results, depending on the type of material used, and the thickness of the top at the upper surface.

24 Claims, 2 Drawing Sheets

SQUEEZE BOTTLE TOP WITH INTEGRAL CLOSURE HOLDER

BACKGROUND OF THE INVENTION

This invention relates generally to the field of dispensers for liquids, of the kind generally categorized as "squeeze bottles". More particularly, this invention relates to a top for an extensible-spout squeeze bottle, wherein the top includes an integral structure for holding a removable closure for the extensible spout.

Squeeze bottles are very well known and come in a wide variety of configurations for a great many different applications. One particular type of squeeze bottle has become quite popular for dispensing lubricating oils and the like. This type of squeeze bottle has an elongated, hollow cap that accommodates a long, hollow, flexible tube that is normally retained within the bottle with just its outermost end portion extending from the opening at the tip of the cap. When it is desired to dispense the contents of the bottle, the tube is extended through the cap to form an elongate, flexible spout, thereby allowing the contents to be dispensed into small orifices and other relatively inaccessible places. Examples of such extensible-spout squeeze bottles are disclosed in U.S. Pat. No. 4,925,128, and U.S. Pat. Des. No. 200,364.

Typically, such extensible-spout squeeze bottles are provided with a small, removable closure (e.g., a cap or stopper) for the opening at the distal end of the dispensing tube that forms the extensible spout. These spout closures are frequently misplaced. Leaving the spout uncovered can lead to contamination of the bottle's contents, or to the accidental leakage or spilling of the contents. To avoid such a situation, it would be advantageous to provide some means for holding the closure onto the bottle when it has been removed from the spout. While there are many ways to accomplish this result, it is desirable to do so without adding significantly to the cost or complexity of the manufacturing process for the squeeze bottle. Furthermore, any modification of the existing structure of the squeeze bottle to include an integral closure holder must not detract from either the principal functions or the overall utility of the bottle. For example, the inclusion of a closure holder must not compromise the fluid-tight seal between the bottle top and the bottle itself.

An example of such an enclosure holder that has been provided on molded plastic squeeze bottles is a male plug extending from the exterior upper surface of the bottle top, and dimensioned to be frictionally received in the interior of the closure.

Nevertheless, even with such a closure holder, the closure may still be misplaced or damaged, thus leaving the contents of the bottle prone to spillage, leakage, and/or contamination.

Therefore, it would be advantageous to provide, on the bottle itself, some means for closing the dispensing tube orifice, even in the absence of a separate closure cap or stopper.

SUMMARY OF THE INVENTION

Broadly, the present invention is an improved bottle top for an extensible-spout squeeze bottle, of the type having a removable closure for the orifice at the distal end of the extensible dispensing tube that forms the extensible spout, wherein the improvement comprises: a male plug extending from the exterior upper surface of the bottle top, and dimensioned to be frictionally received in the interior of the closure; and alternative orifice stopper means, in the form of a cylindrical element, integral with extending upwardly from the plug, and having an outside diameter dimensioned to provide a substantially fluid-tight fit inside the dispensing tube orifice when the tube is extended to bring its orifice into the proximity of the plug.

More specifically, the bottle top and the plug with its integral cylindrical stopper are formed as an integral unit of molded plastic, with the plug and stopper extending upwardly from an annular upper surface of the top that coaxially surrounds the base of the elongate hollow extension through which the dispensing tube extends. The plug has a configuration in the form of one or more axially-extending fins or vanes. In its simplest form, the plug comprises a single vane, linear in cross-section. In the preferred embodiment of the invention, the plug has an axially-fluted configuration, with three or more vanes. The thickness of the vanes is less than that of the annular top portion from which the plug extends, so as to avoid the creation of a significant "sink mark" on the underside of the top, which could interfere with the seal effected between the bottom surface of the bottle top and the rim or lip of the bottle.

The total axial dimension, or height, of the plug and the stopper extending upwardly from it is preferably less than the interior axial dimension of the closure, so that substantially the entire plug/stopper unit is covered by the closure when the closure is installed on it. Also, the plug portion of the plug/stopper unit advantageously comprises approximately one-half to two-thirds the total height of the unit, to assure the secure retention of the closure.

The inclusion of the integral plug on the bottle top allows the spout closure to be removably attached to the bottle when it has been removed from the dispensing tube, thereby reducing the chances of its being lost. The integral stopper element extending upwardly from the plug provides an alternative or secondary closure if the original separate closure is lost or damaged. In such a case, the tube is extended until its orifice reaches the plug, and the stopper element is then inserted into the orifice.

DETAILED DESCRIPTION OF THE PREFERRED EMBODIMENT

Figure 1:
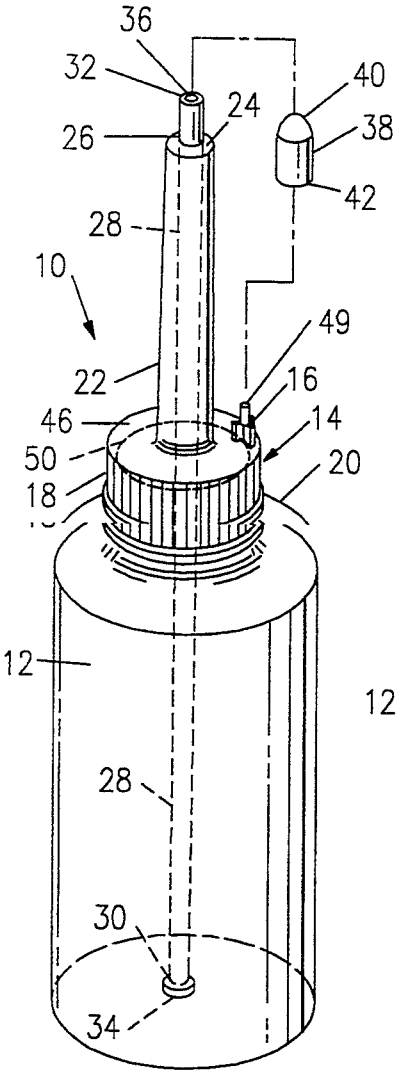
FIG. 1 is a perspective view of an extensible spout squeeze bottle having a top with an integral spout orifice closure holder, in accordance with a preferred embodiment of the present invention, showing the removable spout orifice closure separated from the bottle.
Figure 2:
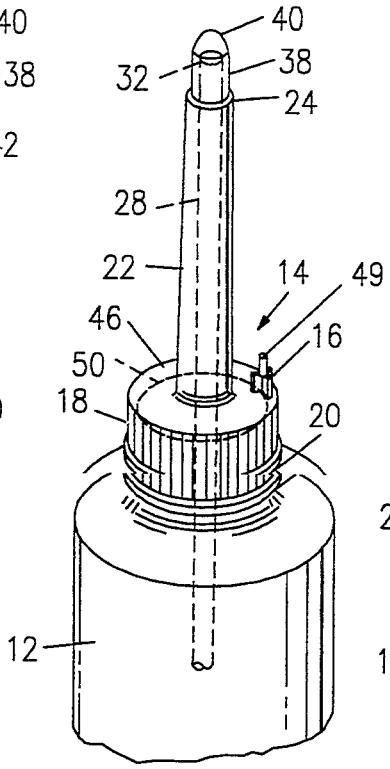
FIG. 2 is a perspective view of the upper portion of the bottle of FIG. 1, showing the spout orifice closure in place as a closure for the orifice in the extensible spout.

Referring now to the drawings, an extensible-spout squeeze bottle 10 assembly is shown, comprising a squeeze bottle 12 and an improved screw-on top 14. The screw-on top 14, in accordance with a preferred embodiment of the present invention, includes an integral plug 16, to be described in detail below. Other than the plug 16, the bottle top 14 may be made in accordance with the structure and method disclosed in U.S. Pat. No. 4,925,128, the disclosure of which is incorporated herein by reference.

Briefly described, the top 14 includes a proximal end that is formed as an internally-threaded fitting 18 that screws onto an externally-threaded neck 20 of the bottle 12. Extending distally (upwardly in the drawings) from the fitting 18 is an elongate, hollow extension 22, terminating in a rounded distal tip 24 with a central orifice 26. An elongate, extensible dispensing tube 28 has an inner or proximal end 30 disposed within the bottle 12, and an outer or distal end 32 that extends out of the orifice 26 in the extension tip 24. A peripheral flange 34 is provided at the proximal end 30 of the tube 28.

When the tube 28 is in the retracted position shown in FIG. 1, its proximal end 30 lies near the bottom of the bottle 12, while its distal end 32 extends through the orifice 26. When it is desired to dispense the contents of the bottle, the distal end 32 of the tube 28 is pulled outwardly from the orifice 26 to the desired position. The flange 34 provides a stop against the interior of the fitting 18, so that the tube 28 cannot be easily removed from the bottle.

The distal end of the dispensing tube 28 has a dispensing orifice 36 through which the bottle's contents are dispensed. The dispensing orifice 36 is covered or closed, when not in use, by a removable cap-like closure 38, having a closed upper end 40 and an open lower end 42 opening into a hollow interior 44.

The internally threaded fitting 18 of the top 14 has an annular outer surface 46 coaxially surrounding the base of the hollow extension 22. Extending upwardly from the annular surface 46 is the plug 16, which is preferably formed integrally with the top 14.

Figure 5:
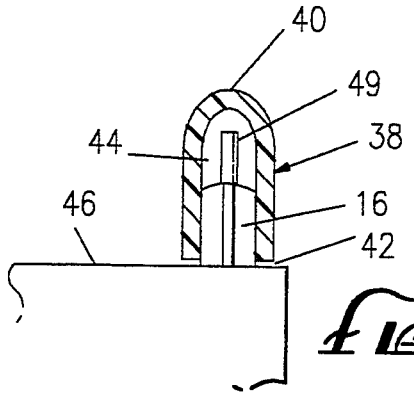
FIG. 5 is a cross-sectional view taken along line 5—5 of FIG. 3.

In the preferred embodiment shown, the plug 16 has an axially-fluted configuration, with three axially-extending vanes 48 that are preferably equidistantly spaced. Extending upwardly from the plug 16, and integral with it, is a substantially cylindrical, rod-like extension or stopper 49. The total height of the plug 16 and the stopper 49 is advantageously somewhat less than the vertical dimension of the interior 44 of the closure 38, as shown in FIG. 5. Preferably, the height of the fluted plug 16 is approximately one-half to two-thirds of the total height of the plug/stopper unit.

The radial width of the vanes 48 is not necessarily uniform throughout the height of the plug 16. In the preferred embodiment, the radial width may decrease from the base of the plug 16 (at its juncture with the annular surface 46) to its juncture with the stopper extension 49, thereby giving the plug 16 a slight taper that facilitates the installation of the closure 38 thereon. The thickness of the vanes 48 may also decrease from the base of the plug 16 to its juncture with the stopper extension 49. The tapered vane width and thickness facilitate the removal of the molded bottle top part from its mold without sticking.

Figure 3:
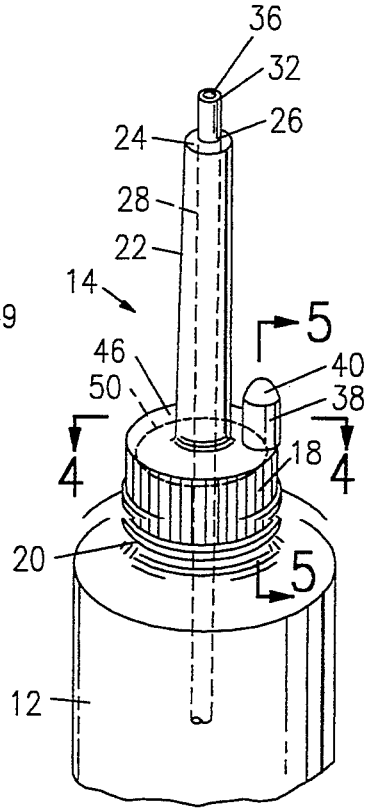
FIG. 3 is a view similar to that of FIG. 2, but showing the spout orifice closure being held on the integral closure holder.
Figure 4:
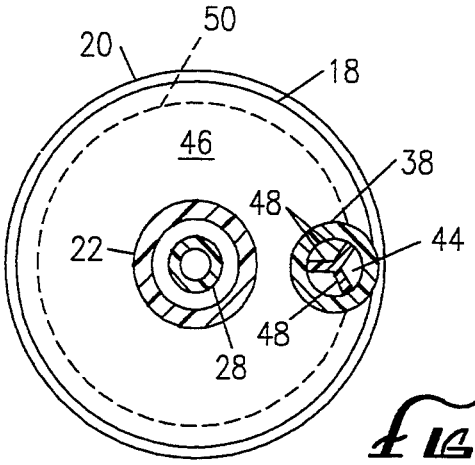
FIG. 4 is a cross-sectional view taken along line 4—4 of FIG. 3.
Figure 6:
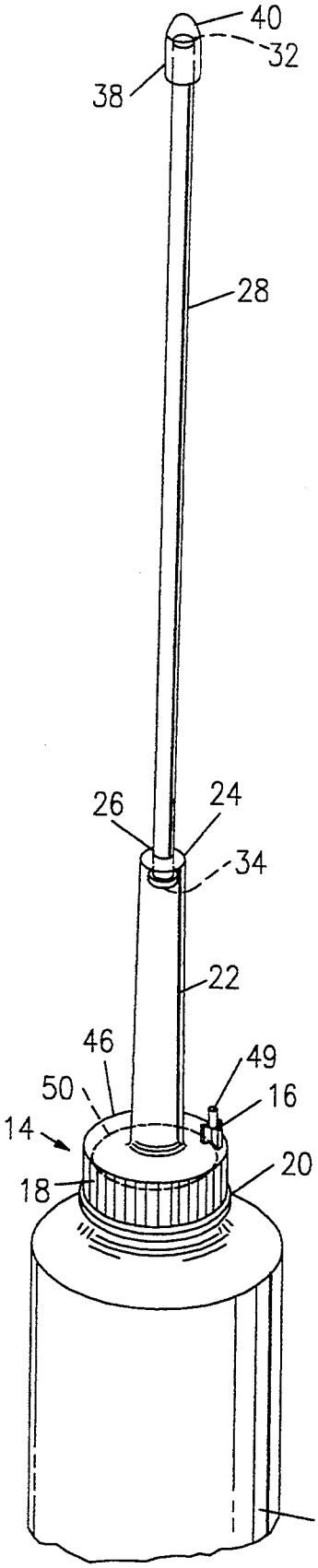
FIG. 6 is a view similar to that of FIG. 2, but showing the dispensing tube spout in its extended position.

Thus, as shown in FIGS. 3, 4 and 5, the closure 38 is installed on the plug 16, the latter being frictionally received in the interior 44 of the closure 38. The fit between the closure 38 and the plug 16 should be tight enough that the closure 38 is retained on the plug 16 when the bottle assembly 10 is inverted, or when it is subjected to the jostling that may normally be expected during use.

The use of a plug 16 having the fluted configuration described above, rather than a solid configuration (e.g., cylindrical or frustoconical) allows the plug to be molded integrally with the top 14 (for strength), without a significant "sink mark" being formed on the underside of the annular surface 46. Such a "sink mark" could interfere with the sealing fit that is desired between the rim or lip 50 of the bottle 12 and the underside of the annular surface 46 (FIG. 4), for the purpose of providing a fluid-tight seal between these two components. Specifically, if the maximum thickness of the vanes 48 is less than the thickness of the top 14 at the annular surface 46 from which the plug 16 extends, the molding process is not likely to leave a significant "sink mark" on the underside of the surface 46, opposite the plug 16. Preferably, the ratio of the maximum thickness of the vanes 48 to the thickness of the top 14 at the annular surface 46 is in the range of about 1:3 to 3:4. In a specific preferred embodiment, this ratio is approximately 2:3, with the vanes 48 having a maximum thickness of approximately 1.2 mm, while the thickness of the top 14 at the annular surface 46 is approximately 1.8 mm.

While the range of thickness ratios mentioned above will provide satisfactory results in nearly all cases, ratios outside this range may also avoid the creation of a seal-impairing "sink mark" depending on the overall dimensions (especially the absolute thickness) of the bottle top 14, the materials from which it is made, and the details of the molding process used to make the part. For example, it may be possible to make the vanes 48 with a maximum thickness that is approximately equal to the thickness of the top 14 at the annular surface 46. Similarly, if the top 14 is fairly thick at the annular surface 46, a thickness ratio significantly less than 1:3 may be successfully employed.

Figure 7:
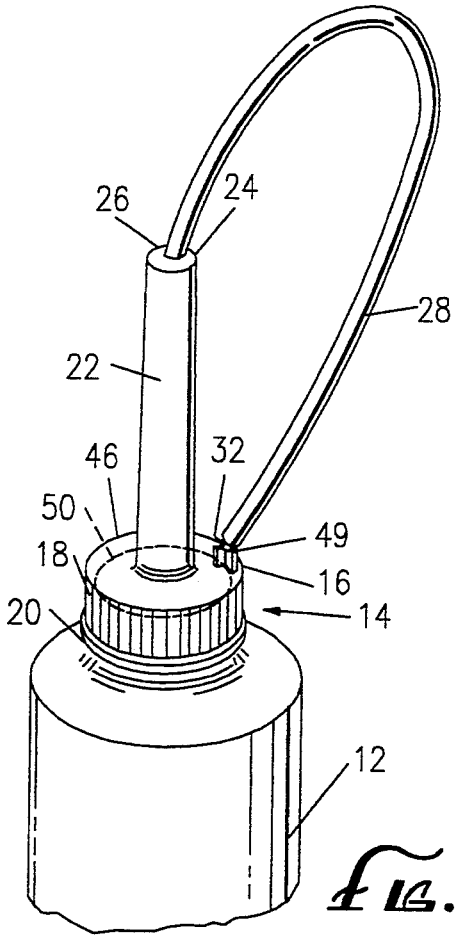
FIG. 7 is a view similar to that of FIG. 6, but showing the dispensing tube spout in a position in which its orifice is closed by the stopper element on the integral closure holder.

Referring now to FIG. 7, the function of the stopper extension 49 is shown. If the original closure or cap 38 is lost or damaged, the stopper extension 49 provides an alternative or secondary stopper or closure for the dispensing tube orifice 36. The dispensing tube 28 is simply extended until its distal tip 32 is brought into the proximity of the plug 16 and the stopper extension 49, and the stopper extension is then inserted into the dispensing tube orifice 36. To provide a fluid-tight closure for the dispensing tube orifice 36, the outside diameter of the stopper extension 49 should be approximately the same as (or slightly larger than) the inside diameter of the dispensing tube orifice 36, so as to provide an interference fit within the orifice.

Although the preferred embodiment of the invention, as described herein, contemplates a three-vaned configuration for the fluted plug 16, other configurations may be used to equal advantage. For example, a plug that is substantially linear in cross-section (i.e., a single vane) may be used, as may be a plug that is cruciform in cross-section (i.e. four vanes). Indeed, any configuration comprising one or more axially-extending vanes of substantially equal radial width along a given cross section may be used, since any such configuration will avoid the creation of a significant "sink mark" during the molding process, if the proper thickness relationships, as described above, are maintained.

From the foregoing description, it can be seen that the present invention provides an effective solution to the problem of misplaced closures, without adding appreciably to the overall cost of the bottle assembly, and without significantly compromising or impairing any of the other structural or functional characteristics of the squeeze bottle.

While a preferred embodiment of the invention has been described herein, it is understood that a number of variations and modifications may suggest themselves to those skilled in the pertinent arts. The most readily apparent example of such a modification is, as mentioned above, the configuration of the plug 16, which may be varied, for example, to accommodate closures of different sizes and configurations. Also, the location and size of the plug may be changed. The invention may also be embodied in a top that attaches to a bottle by means other than threads, and the bottle does not necessarily have to be a squeeze bottle. Furthermore, the bottle does not have to include an extensible spout. These and other modifications that may suggest themselves are considered within the spirit and scope of the present invention as defined in the claims that follow.

What is claimed is:

1. An improved container top, of the type having an elongate hollow extension extending upwardly from its upper surface and an extensible dispensing tube slidably disposed in the extension, the tube having an orifice for the dispensing of a liquid from a container to which the top is attached, the top further including a removable closure for the orifice, the closure comprising a substantially cylindrical body with an open end communicating with a hollow interior, wherein the improvement comprises:

closure retention means on the upper surface and dimensioned to be received into the open end and the interior of the closure, so that the closure is retained thereon with a frictional fit; and orifice stopper means, integral with the closure retention means, for selectively sealing the orifice as an alternative to the closure when the tube is extended to bring the orifice into the proximity of the closure retention means.

2. The improvement of claim 1, wherein the orifice stopper means includes a cylindrical element extending upwardly from the closure retention means, said cylindrical element having an outside diameter dimensioned to provide a substantially fluid-tight fit inside the orifice.

3. The improvement of claim 1, wherein the closure retention means is formed integrally with the upper surface.

4. The improvement of claim 1, wherein the closure retention means extends upwardly from the upper surface.

5. The improvement of claim 1, wherein the closure retention means comprises a plug formed integrally with, and extending upwardly from, the upper surface.

6. The improvement of claim 5, wherein the plug comprises at least one axially-extending vane having a thickness less than or equal to the thickness of the top at the upper surface.

7. The improvement of claim 6, wherein the plug is axially fluted so as to comprise a plurality of axially-extending vanes of approximately equal radial width along a given cross-section.

8. The improvement of claim 7, wherein the plug has three substantially equidistantly-spaced vanes.

9. The improvement of claim 6, wherein the ratio of the thickness of the vanes to the thickness of the top at the upper surface is in the range of about 1:3 to 3:4.

10. The improvement of claim 9, wherein the ratio is about 2:3.

11. The improvement of claim 6, wherein the orifice stopper means includes a cylindrical element extending upwardly from the closure retention means, said cylindrical element having an outside diameter dimensioned to provide a substantially fluid-tight fit inside the orifice.

12. The improvement of claim 7, wherein the orifice stopper means includes a cylindrical element extending upwardly from the closure retention means, said cylindrical element having an outside diameter dimensioned to provide a substantially fluid-tight fit inside the orifice.

13. The improvement of claim 9, wherein the orifice stopper means includes a cylindrical element extending upwardly from the closure retention means, said cylindrical element having an outside diameter dimensioned to provide a substantially fluid-tight fit inside the orifice.

14. An improved molded plastic container top, of the type having an elongate hollow extension extending upwardly from its upper surface and an extensible dispensing tube slidably disposed in the extension, the tube having an orifice for the dispensing of a liquid from a container to which the top is attached, the top further including a removable closure for the orifice, the closure comprising a substantially cylindrical body with an open end communicating with a hollow interior, wherein the improvement comprises:

a plug formed integrally with, and extending upwardly from, the upper surface, the plug comprising at least one axially-extending vane having a thickness less than or equal to the thickness of the top at the upper surface, the plug being dimensioned to be received into the open end and interior of the closure so that the closure is retained thereon with a frictional fit; and orifice stopper means, integral with the plug, for selectively sealing the orifice as an alternative to the closure when the tube is extended to bring the orifice into the proximity of the plug.

15. The improvement of claim 14, wherein the orifice stopper means includes a cylindrical element extending upwardly from the plug, said cylindrical element having an outside diameter dimensioned to provide a substantially fluid-tight fit inside the orifice.

16. The improvement of claim 14, wherein the plug is axially fluted so that it comprises at least three substantially equidistantly-spaced vanes of approximately equal radial width along a given cross section.

17. The improvement of claim 16, wherein the orifice stopper means includes a cylindrical element extending upwardly from the plug, said cylindrical element having an outside diameter dimensioned to provide a substantially fluid-tight fit inside the orifice.

18. The improvement of claim 14, wherein the ratio of the thickness of each vane to the thickness of the top at the upper surface is in the range of about 1:3 to about 3:4.

19. The improvement of claim 18, wherein the ratio is about 2:3.

20. The improvement of claim 18, wherein the plug is axially fluted so that it comprises at least three substantially equidistantly-spaced vanes.

21. The improvement of claim 20, wherein the orifice stopper means includes a cylindrical element extending upwardly from the plug, said cylindrical element having an outside diameter dimensioned to provide a substantially fluid-tight fit inside the orifice.

22. An improved molded plastic container top, of the type having an elongate hollow extension extending upwardly from its upper surface and an extensible dispensing tube slidably disposed in the extension, the tube having an orifice for the dispensing of a liquid from a container to which the top is attached, the top further including a removable closure for the orifice, the closure comprising a substantially cylindrical body with an open end communicating with a hollow interior, wherein the improvement comprises:

a plug formed integrally with, and extending upwardly from, the upper surface, the plug comprising at least three substantially equidistantly-spaced axially-extending vanes, the thickness of each of the vanes being less than or equal to the thickness of the top at the upper surface, the plug being dimensioned to be received into the open end and interior of the closure so that the closure is retained thereon with a frictional fit; and orifice stopper means, integral with the plug, for selectively sealing the orifice as an alternative to the closure when the tube is extended to bring the orifice into the proximity of the plug, the orifice stopper means including a cylindrical element extending upwardly from the plug, said cylindrical element having an outside diameter dimensioned to provide a substantially fluid-tight fit inside the orifice.

23. The improvement of claim 22, wherein the ratio of the thickness of each of the vanes to the thickness of the top at the upper surface is in the range of about 1:3 to about 3:4.

24. The improvement of claim 23, wherein the ratio is approximately 2:3.

* * * * *